US009591415B2

(12) United States Patent
Rasmussen et al.

(10) Patent No.: US 9,591,415 B2
(45) Date of Patent: Mar. 7, 2017

(54) HEARING AID COMPRISING A FLEXIBLE CONNECTION MEMBER

(71) Applicant: Oticon A/S, Smørum (DK)

(72) Inventors: Karsten Bo Rasmussen, Smørum (DK); Povl Koch, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/679,509

(22) Filed: Apr. 6, 2015

(65) Prior Publication Data

US 2015/0289061 A1 Oct. 8, 2015

(30) Foreign Application Priority Data

Apr. 7, 2014 (EP) ..... 14163688

(51) Int. Cl.

*H04R 25/00* (2006.01)
*H04R 25/02* (2006.01)
*H04R 1/10* (2006.01)

(52) U.S. Cl.

CPC ..... *H04R 25/608* (2013.01); *H04R 1/1066* (2013.01); *H04R 25/02* (2013.01); *H04R 1/1091* (2013.01); *H04R 25/65* (2013.01); *H04R 2225/023* (2013.01); *H04R 2225/025* (2013.01); *H04R 2460/17* (2013.01)

(58) Field of Classification Search

CPC .... H04R 1/1016; H04R 1/105; H04R 1/1058; H04R 1/1066; H04R 1/1091; H04R 1/42; H04R 25/02; H04R 25/60; H04R 25/608; H04R 25/65–25/658; H04R 2225/023; H04R 2225/025; H04R 2225/61; H04R 2460/11; H04R 2460/15; H04R 2460/17; B29C 61/00; B29C 61/02; B29C 61/04; A61F 11/06; A61F 11/08; A61F 11/10; A61F 2011/085

See application file for complete search history.

(56) References Cited

U.S. PATENT DOCUMENTS 3,061,689 A * 10/1962 McCarrell ..... H04R 25/45 381/328
6,212,283 B1 4/2001 Fletcher et al.
6,695,093 B1 * 2/2004 Falco ..... A61F 11/08 181/130

(Continued)

FOREIGN PATENT DOCUMENTS

WO WO 96/21334 A1 7/1996

*Primary Examiner* — Joseph J Nguyen
*Assistant Examiner* — Joshua Kaufman
(74) *Attorney, Agent, or Firm* — Birch, Stewart, Kolasch & Birch, LLP

(57) ABSTRACT

A hearing aid device configured to be inserted into the ear canal of a hearing aid user. The hearing aid includes a receiver, a hearing instrument body, and a connection member extending between the hearing instrument body and the receiver. The connection member is a permanent part of the hearing aid device and the connection member has a stiffness that allows the receiver to be inserted into the ear canal by moving the hearing instrument body towards the eardrum. The connection member achieves a first stiffness sufficiently large to insert the hearing aid device into the ear canal and achieves a second significantly reduced stiffness which makes the hearing aid device comfortable to wear for the user.

4 Claims, 10 Drawing Sheets

(56) References Cited

U.S. PATENT DOCUMENTS

| | | | | |
|---|---|---|---|---|
| 8,594,807 | B2 | 11/2013 | Colvin | |
| 2006/0004323 | A1 | 1/2006 | Chang et al. | |
| 2009/0067661 | A1* | 3/2009 | Keady | H04R 1/1091 381/375 |
| 2010/0012420 | A1* | 1/2010 | Keady | A61F 11/10 181/135 |
| 2013/0090630 | A1 | 4/2013 | Winegar | |
| 2014/0010396 | A1 | 1/2014 | Karamuk et al. | |

* cited by examiner

HEARING AID COMPRISING A FLEXIBLE CONNECTION MEMBER

FIELD

The present disclosure generally relates to a hearing aid device, which has a flexible connection member between the hearing instrument body and the receiver. The disclosure more particularly relates to a hearing aid device that is provided with a connection member that is configured to be brought into a flexible state and into a less flexible state.

Hearing aids which are placed in the ear canal needs to be flexible in order to be comfortable for the user to wear them. However, if the hearing aids are flexible, then they are impossible or at least very difficult to insert into the ear canal.

DESCRIPTION OF RELATED ART

The American patent U.S. Pat. No. 8,594,807 describes a material in which the flexibility of the material is temperature dependent. The material has been used as an implant in human bodies wherein several electrodes has been placed on the material. The material is rigid prior to implanting the material in a human being, wherein the material turns non-rigid after implantation because of the temperature of the human body. However, this type of material has not been used in an ear canal previously or in connection to a hearing aid.

The American published patent application U.S. 2014/0010396 describes a CIC (completely in the canal) hearing aid, which comprises a lateral module, a medial module and a flexible joint assembly connecting the medial module and the lateral module in such a manner in which the two modules are movable relative to each other.

However, it is not possible to insert such a CIC hearing aid with a flexible joint in the ear canal. To solve this problem, two stiff wires have been inserted in the hearing aid to help stabilize the hearing aid while inserting it in the user. After the insertion has been completed the wires can be withdrawn from the hearing aid. However, it is very impractical to withdraw such wires from the inserted hearing aid without withdrawing the hearing aid again from the ear canal.

Thus, there is need for a hearing aid device which a) has a flexible connection making the hearing aid device comfortable for the hearing aid user to wear, and b) is easy to insert into the ear canal.

It is an object of the present disclosure to provide a hearing aid device, which has a flexible connection making the hearing aid device comfortable for the hearing aid user to wear, and is easy to insert into the ear canal.

SUMMARY

The object of the present disclosure can be achieved by a hearing aid device as defined in claim 1. Preferred embodiments are defined in the dependent sub claims and explained in the following description and illustrated in the accompanying drawings.

The hearing aid device according to an embodiment of the disclosure is a hearing aid device configured to be inserted into the ear canal of a hearing aid user comprises a receiver, a hearing instrument body, and a connection member. The connection member is a permanent part of the hearing aid device and is extended between the hearing instrument body and the receiver. The connection has a stiffness that allows the receiver to be inserted into the ear canal by moving the hearing instrument body towards the eardrum. The connection member comprises means for achieving a first stiffness sufficient large to insert the hearing aid device into the ear canal and the means for achieving a second significantly reduced stiffness, which makes the hearing aid device comfortable to wear for the user. The second significantly reduced stiffness is significantly lower than the first stiffness.

Because of the different modes of stiffness in the connection member, it is achieved that the hearing aid device is both easily inserted in the ear of the hearing aid user and allows the user to wear the hearing aid device with minimal discomfort. The connection member comprises means for achieving a first stiffness sufficient large to insert the hearing aid device into the ear canal. The connection member also comprises means for achieving a second significantly reduced stiffness, which makes the hearing aid device comfortable to wear for the user. The second significantly reduced stiffness is significantly lower than the first stiffness.

Because, the receiver is primarily located in the bony part of the ear canal, while the hearing instrumental body is primarily located in the cartilaginous part of the ear canal, it is necessary to displace the hearing aid device through the ear canal.

The bony part of the ear canal is relatively pain sensitive, but also relative stable during actions such as chewing or speaking, while the cartilaginous part of the ear canal encounters large radial and axial deformations during such actions.

If the connection member is not flexible (enough), it will be uncomfortable for the user to wear the hearing aid device during actions such as chewing or speaking. The connection member is a permanent part of the hearing aid device, which limits the number of adjustments needed to correct the hearing aid position.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A "hearing aid device" further refers to a device such as an earphone or a headset adapted to receive audio signals electronically, possibly modifying the audio signals and providing the possibly modified audio signals as audible signals to at least one of the user's ears.

A hearing device may comprise a single unit or several units communicating electronically with each other.

More generally, a hearing aid device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal.

Some hearing aid devices may comprise multiple input transducers, e.g. for providing direction-dependent audio signal processing. In some hearing devices, the receiver may be a wireless receiver. In some hearing devices, the receiver may be e.g. an input amplifier for receiving a wired signal.

The hearing aid device may comprise an amplifier that constitutes the signal processing circuit.

The receiver refers to a module, which contains the hearing aid loudspeaker.

The hearing instrumental body may refer to a module, which includes the battery, the microphone and the audio signal processing electronics including the amplifier.

Typically, the receiver is primarily located in the bony part of the ear canal, while the hearing instrumental body is located in the cartilaginous part of the ear canal.

A connection member refers to a member that is constructed to be a permanent part of the hearing aid device. The connection member connects the hearing instrumental body and the receiver. The connection member (is also constructed in such a manner that it) has a stiffness that allows the hearing aid device to be inserted into the ear canal by moving the hearing instrument body towards the eardrum, and an ability for second significantly reduced stiffness which makes the hearing aid device comfortable to wear for the user. The connection member may have any suitable shape, but is advantageously shaped as a wire, tube, or as a shield protecting electronic wires.

By the term stiffness is meant the ability of a member to maintain its geometrical shape when a force is applied to it. A high degree of stiffness means that the member has a low degree of flexibility thus being relatively rigid, while a low degree of stiffness means that the member has a high degree of flexibility, thus being relatively "non-rigid" when compared to the member having high degree of stiffness.

By the term a "flexible member" is understood a member, which is able to be bended, stretched, expanded and compressed in either (or both) the axial direction and/or the radial direction of the member.

By non-rigid is understood a member, which is able to be stretched, expanded or compressed in any (e.g. the axial and/or the radial) direction.

By shapeable is understood a member, which is able to be formed according to the surroundings, for example a member which can be shaped to fit the ear canal.

By non-flexible is understood a member, which requires a high force to be bended, stretched, expanded and compressed.

It may be advantageous, that the connection member is made of a material which is temperature dependent, such that the connection member has at least two different modes of stiffness; for example, one first mode of stiffness which is sufficiently large to insert the hearing aid device into the ear canal at temperatures lower than a first temperature that is less or equal to the temperature within the ear canal, and that the connection member has a second significantly lower stiffness at temperatures above the first temperature.

Hereby it is achieved that the hearing aid device can easily be inserted into the ear canal e.g. when it is stored at room temperature. At the same time, when the temperature of the connection member is raised to a level above the first temperature, the stiffness of the connection member is reduced so that the hearing aid device is comfortable to wear for the user.

It may be beneficial that the first temperature is within the range of 25-35° C., preferably between 27 and 30° C., such as 30° C.

Hereby it is achieved that the hearing aid device can easily be inserted into the ear canal at room temperature and that the stiffness of the connection member is reduced when the temperature of the connection member is raised due to heating caused by the temperature difference between the hearing aid device and the temperature within the ear canal.

It may also be advantageous, that the hearing aid device is able to be safely extracted from the ear canal because one or more strong and very flexible thin wires are located in the flexible connection member. The hearing aid device can safely be extracted, because the pulling force is transferred by these wires instead of by the flexible and temperature sensitive material. The connection member may be manufactured from the temperature sensitive material, or the temperature sensitive material may act as a mechanical support for a more flexible tubing material containing the wires for the electrical connection and mechanical stability during pull-out. The temperature sensitive material may have an increased stiffness at temperatures below a predefined temperature (e.g. below 30° C.) and a significantly reduced stiffness at temperatures at or above the predefined temperature (e.g. 30° C.).

It may also be beneficial, that the hearing aid device comprises a mechanical insertion tool that comprises means for regulating the stiffness of the connection member.

It may be advantageous that the hearing aid device comprises means for mechanically bringing the connection member into: a) a first state in which the connection member has a first stiffness sufficiently large to insert the hearing aid device into the ear canal and b) a second state in which the stiffness of the connection member is significantly reduced.

Hereby it is possible to, by use of mechanical means, providing a first stiffness allowing the hearing aid device to be inserted into the ear canal and at the same time using the mechanical means to reduce the stiffness of the connection member and thus making the hearing aid device comfortable to wear for the hearing aid user.

It may be beneficial that the hearing aid device comprises an insertion tool and that the hearing aid device comprises means for fully or partly receiving the insertion tool or a member mechanically attached to the insertion tool, and that the stiffness of the connection member is increased when the insertion tool or the member mechanically attached to the insertion tool, is fully or partly received by the insertion tool or the member mechanically attached to the insertion tool.

Hereby the stiffness of the connection member can easily be increased by inserting the insertion tool into the hearing aid.

It may be advantageous that the hearing aid device comprises an insertion tool, a displacement member slidably arranged within the hearing instrument body of the hearing aid device, where the displacement member is arranged in such a manner that displacement of the insertion tool in a first direction causes displacement of the displacement member towards the receiver resulting in an increased stiffness of the connection member, where the displacement member is arranged in such a manner that displacement of the insertion tool in a second direction causes displacement of the displacement member away from the receiver and further away from the connection member into the hearing instrumental body resulting in a significantly reduced stiffness of the connection member.

Hereby it is possibly to provide a reliable and simple mechanical way of controlling the stiffness of the connection member.

It may be beneficial that the hearing aid device comprises a press button arranged at the distal end of the hearing aid device, which press button comprises means for displacing the displacement member from the hearing instrumental body at least partly into the connection member and hereby increasing the stiffness of the connection member, where the hearing aid device moreover comprises means for at least partly displacing the displacement member from the connection member into the hearing instrumental body and hereby significantly reducing the stiffness of the connection member.

Hereby it is possible to provide a user-friendly and reliable hearing aid device in which the stiffness of the connection member can be regulated by simple mechanical means.

It may be an advantage that the means for at least partly displacing the displacement member from the connection member into the hearing instrumental body is a spring.

Such construction is simple, reliable and requires a minimum level of service.

It may beneficial that the hearing aid device comprises a connection member that comprises means for being compressed into a state into which the stiffness of the connection member is significantly larger than the stiffness of the connection member being in an less compressed state.

Hereby it is possible to provide a connection member having a stiffness that can be regulated in an easy and simple way.

It may be advantageous that the connection member comprises means for at least partly regaining its rest length when no external force is applied to compress the connection member along its longitudinal axis.

Hereby a low stiffness may be achieved simply by reducing the force applied to compress the connection member.

It may be an advantage that the connection member comprises a compression structure comprising a multiple number of soft elements and a multiple number of stiff elements, wherein the soft elements and the stiff elements are placed alternately in succession, where the stiffness of the stiff elements is significantly larger than the stiffness of the soft elements.

Such construction is easy to provide and moreover it easy to adjust the length of the connection member according to given requirements.

It may be beneficial that a ball bearing is arranged between the soft elements and the stiff elements.

Such construction provides flexibility in several directions and thus increases the comfort for the hearing aid user.

It may be advantageous that the insertion tool comprises a magnet provided at its distal end and that the receiver comprises a magnet that is arranged to receive the of the insertion tool.

Hereby it is possible to provide a firm attachment of the insertion tool to the receiver.

It may be an advantage that a through-going bore configured to receive the insertion tool is provided in the hearing instrumental body. The through-going bore may also serve as a vent channel for pressure release.

Hereby it is possible to guide the insertion tool through the hearing instrument body.

It may be beneficial that the connection member at least partly is surrounded by a foam member, where the stiffness of the foam is temperature dependent.

Hereby it is possible to provide a connection member that is protected by the foam member.

In one embodiment of the disclosure, the hearing aid device comprises a receiver connected to a hearing instrumental body connected by a connection member, where the hearing aid device comprises an insertion tool that comprises means for regulating the stiffness of the connection member in such a manner that when the insertion tool is connected to the hearing aid device, the connection member more rigid than when the insertion tool is not connected to the hearing aid device.

The insertion tool may be configured to initially being connected to the hearing instrumental body, resulting in a displacement of a displacement member from the hearing instrumental body into the connection member, causing an increased stiffness of the connection member, where the stiffness is sufficiently large to insert the hearing aid device into the ear canal.

When the hearing aid device is placed in the right position within the ear canal, the insertion tool may be removed from the hearing instrumental body, causing displacement of the displacement member from the connection member into the hearing instrumental body, so that the stiffness of the connection member is significantly reduced.

The connection member may be made of a relative flexible, non-rigid and shapeable material. Hereby it is possible to provide a hearing aid device that is flexible, shapeable and non-rigid and that is able to adapt it shape according to movements made by the user when chewing and speaking.

In order to get the hearing aid device inserted in the ear canal of the hearing aid user, it is important that the connection member is relatively rigid. To provide the required rigidity, an insertion tool may be inserted into the hearing instrumental body and be attached to the receiver by magnetic means, when inserting the hearing aid device in the ear canal.

The insertion tool may comprise a magnet. The magnet may be arranged in that end of the insertion tool that faces the receiver. The receiver also comprises a magnet configured to receive the magnet of the insertion tool. The magnet may preferably be placed at the end of the receiver closest to the hearing instrumental body.

By magnetic means is understood, that the magnet on the insertion tool and the receiver attracts each other and therefore has opposite magnetic polarities.

In one embodiment of the disclosure, the connection member is made of a relative flexible, non-rigid and shapeable material. This makes it possible for the hearing aid device to be flexible, shapeable and non-rigid and be able to follow the movements such as chewing and speaking without making it uncomfortable for the user to wear the hearing aid device. The hearing aid device may comprise an insertion tool comprising means for being inserted into the hearing instrumental body, being wrapped around the connection member, and finally attached to the receiver by magnetic means.

Wrapping the insertion tool around the connection member makes the connection member non-flexible and rigid due to friction between the insertion tool and the connection member.

The insertion tool may comprise a magnet that may be arranged in that end of the insertion tool that is intended to be connected to the receiver. The receiver may also comprise a magnet. The magnet may be placed at the end of the receiver that is closest to the hearing instrumental body.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings:

FIG. 2 *b*) shows a cross-sectional view of a hearing aid device according to an embodiment of the disclosure, wherein the connection member has a shield structure

DETAILED DESCRIPTION

Figure 1:
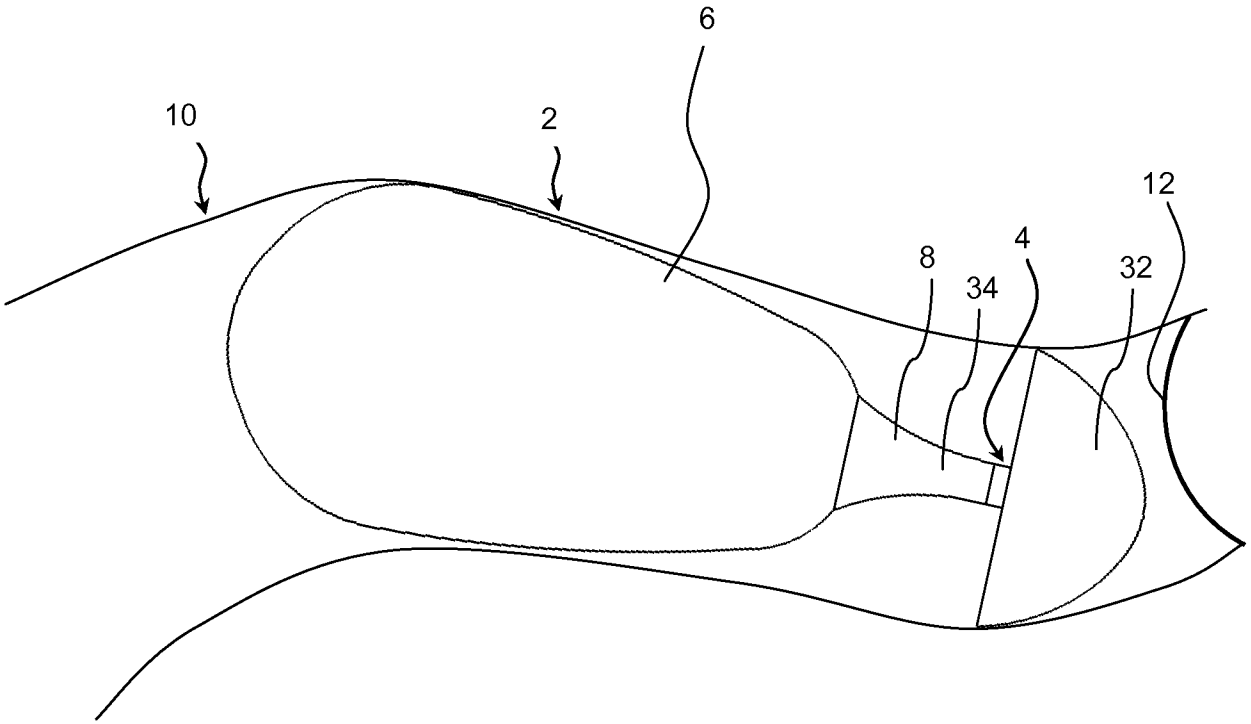
FIG. 1 shows a schematic view of an ear canal in which a hearing aid device according to an embodiment of the disclosure is arranged.

Referring now in detail to the drawings for the purpose of illustrating preferred embodiments of the present disclosure a schematically view of an ear canal 10 in which a hearing aid device 2 according to an embodiment of the disclosure is arranged is illustrated in FIG. 1.

FIG. 1 illustrates a schematic view of a hearing aid device 2 located in the ear canal 10 of a hearing aid user. The hearing aid device 2 comprises a hearing instrumental body 6, which is connected to a receiver 4 by a connecting member 8. The receiver 4 is located close to the eardrum 12, whereas the hearing instrumental body 6 is located further away from the eardrum 12.

The connection member 8 is positioned between the hearing instrumental body 6 and the receiver 4. The hearing instrumental body 6 comprises a housing, which comprises a battery, a microphone and the audio signal processing electronics including an amplifier. The receiver 4 comprises a housing, which comprises the hearing aid loudspeaker (not shown). The receiver 4 is protected by a dome 32 that is attached to the receiver 4. The dome 32 also makes the receiver comfortable to wear in the ear. The receiver 4 is primarily located in the bony part of the ear canal 10, while the hearing instrumental body 6 is primarily located in the cartilaginous part of the ear canal 10. The bony part of the ear canal 10 is relatively pain sensitive, but also relative stable during actions as chewing or speaking, while the cartilaginous part of the ear canal 10 encounters large radial and axial deformations during such actions.

The connection member 8 is constructed to be a permanent part of the hearing aid device 2, which means that the connection member 8 cannot be removed from the hearing aid device 2. The connection member 8 is constructed in such a manner that it has a stiffness that allows the hearing aid device 2 to be inserted into the ear canal 10 by moving the hearing instrument body 6 towards the eardrum 12.

When the hearing aid device 2 is inserted into the ear canal 10, the connection member 8 has the ability to change flexibility by reducing its stiffness due to increasing temperature of the connection member. An increased flexibility makes the hearing aid device 2 comfortable to wear for the user. The connection member 8 comprises a temperature sensitive material 34, which has a stiffness that decreases when the temperature is increased. The connection member 8 may be relative stiff and rigid at temperatures between 20-30° C., whereas the stiffness of the connection member 8 may be significantly reduced when the temperature of the connection member is increased to above 30° C.

The advantage of such a material is that it can be used to insert the hearing aid device 2 into the ear canal 10 because the connection member 8 is relative stiff and rigid at room temperature. On the other hand when the hearing aid device 2 is inserted into the ear canal 10, the hearing aid device 2 is warmed by the human body to the temperature above 30° C., whereby the stiffness of the connection member 8 is reduced making it more comfortable to wear the hearing aid device by the hearing aid user.

The connection member 8 has a conical shape, but it may have any other suitable shape. The hearing aid device 2 may be provided with means for safely extracting the hearing aid device 2 from the ear canal 10. These means may comprise one or more (e.g. flexible and thin) wires (see FIG. 2*b*) located within and extending through the flexible connection member 8. By use of these means the hearing aid device 2 can then be safely extracted, because the pulling force is transferred by these wires instead of by the flexible and temperature sensitive material.

The connection member 8 may at least partly be manufactured in the temperature sensitive material 34. The temperature sensitive material 34 may act as a mechanical support for a more flexible tubing material containing wires for the electrical connection and mechanical stability during pull-out.

Figure 2:
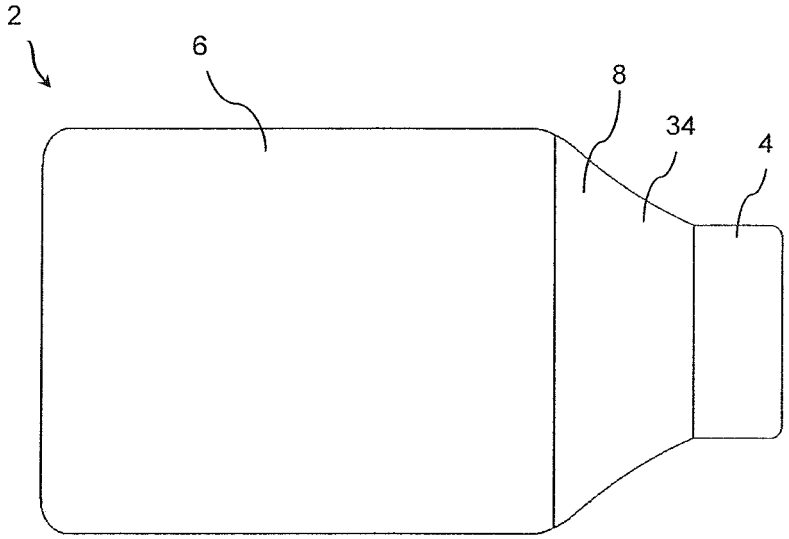
FIG. 2 *a*) shows a schematic view of a hearing aid device according to an embodiment of the disclosure, wherein the connection member has a shield structure.
Figure 2:
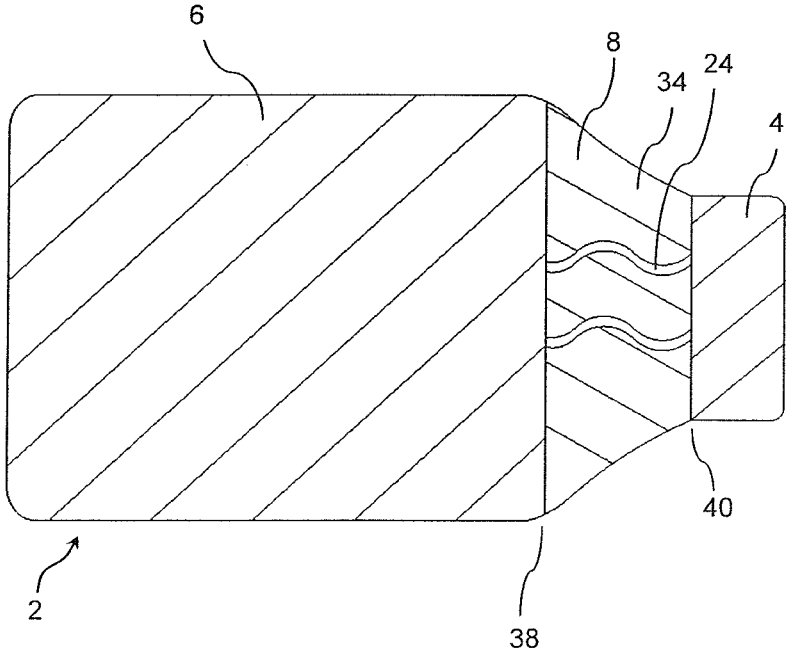

FIG. 2 *a*) illustrates a schematic view of a hearing aid device 2. The hearing aid device 2 comprises a hearing instrumental body 6 and a receiver 4, which are connected by a connection member 8. The connection member 8 comprises a temperature sensitive material 34, which is relative stiff and rigid at temperatures below 30° C. and is softer (less stiff and less rigid) when the temperature is increased to above 30° C.

Hereby the hearing aid device 2 can easily be inserted into the ear canal 10 because of the relative large stiffness of the connection member 8 at room. On the other hand, when the hearing aid device 2 is inserted into the ear canal it will gradually be warmed up by the human. Accordingly, the stiffness of the connection member 8 is reduced.

The connection member 8 has a conical shape and is attached to the proximal end of the hearing instrumental body 6 (see FIG. 1) and to the distal end of the receiver 4. The proximal and distal are in relation to the ear drum when the hearing aid device is located in the ear canal, i.e. end that is closer to the ear drum is proximal while the end further away from the ear drum is distal. The connection member 8 may have any suitable geometrical shape.

FIG. 2 *b*) illustrates a cross-sectional view of the hearing aid device 2 shown in FIG. 2 *a*). The hearing aid device 2 comprises a hearing instrumental body 6 and a receiver 4, that are mechanically connected to each other by means of a connection member 8. The connection member 8 comprises a temperature sensitive material 34, which is relative stiff and rigid at temperatures below 30° C., but gradually becomes less stiff with increasing temperatures. Accordingly, the hearing aid device 2 is configured to be inserted into the ear canal when it is stored (at room temperature) and configured to be flexible (less stiff) when the hearing aid device is arranged in the ear canal and the connection member 8 is heated due to the temperature difference between the connection member 8 and the temperature in the ear canal.

The hearing aid device 2 is adapted to be safely extracted from the ear canal because a number of wires 24 are located in and extends through the flexible connection member 8. These wires 24 are preferably relatively strong, flexible and thin. By means of the wires the hearing aid device 2 can be safely removed from the ear canal. The wires 24 may be mechanically connected to further engagement means (not shown, e.g. a pull out string) that are provided in a manner so that they can be handled by the hearing aid user.

The wires 24 ensure that the main part of the pulling force (when a force is applied to remove the hearing aid device from the ear canal) is transferred by these wires 24 instead of by the flexible and temperature sensitive material 34.

It may be an advantage that the connection member 8 comprises a temperature sensitive material 34 that may be configured to function as a mechanical support for a (even more) flexible tubing material containing the wires for the electrical connection and mechanical stability during pull-out.

Figure 3:
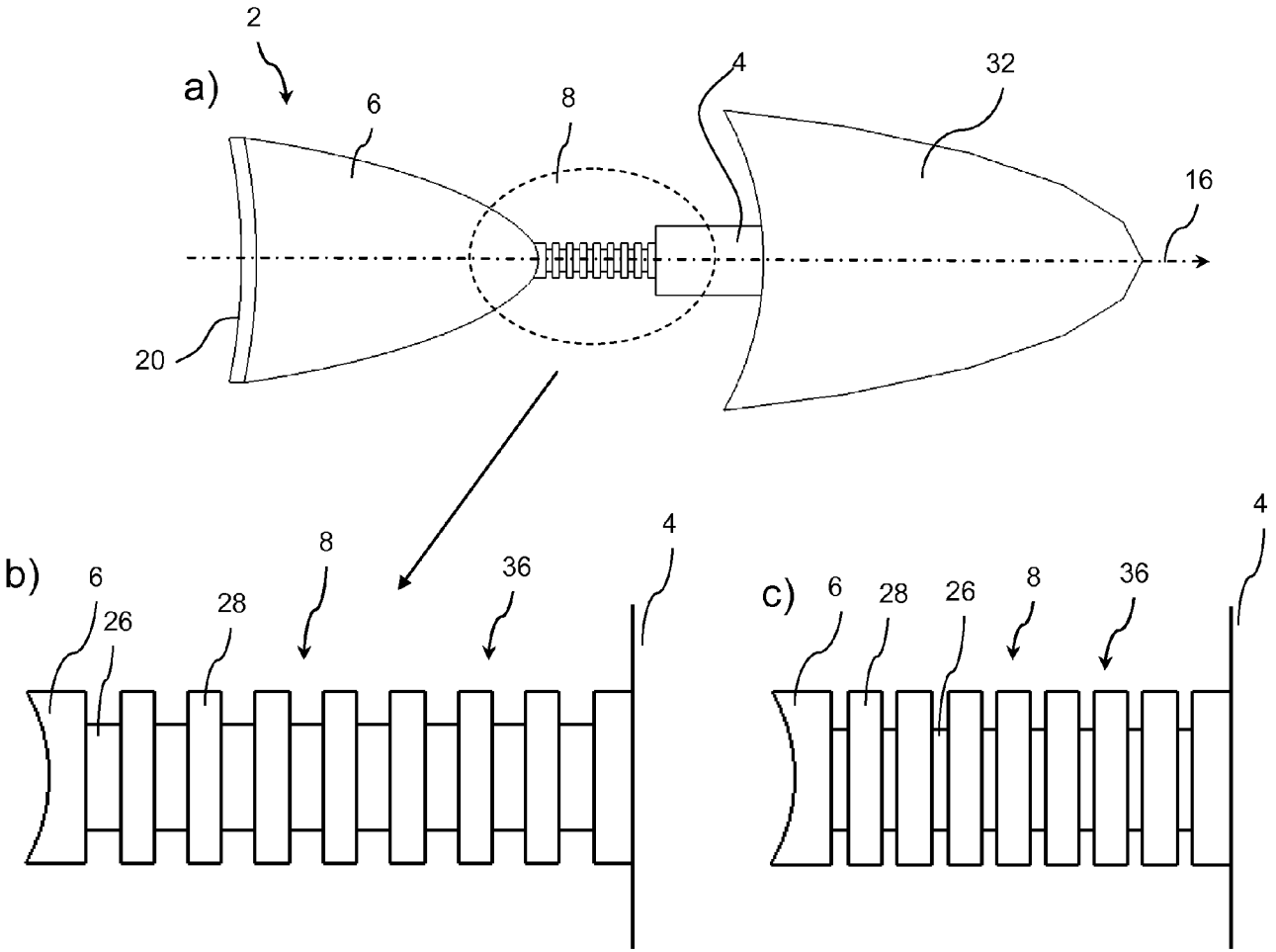
FIG. 3 shows schematic views of a hearing aid device according to an embodiment of the disclosure, wherein the connection member comprises a compression structure.

FIG. 3 illustrates a schematic view of a hearing aid device 2 according to an embodiment of the disclosure. The hearing aid device 2 comprises a hearing instrumental body 6 and a receiver 4 interconnected by a compressible connection member 8. The distal end of the receiver 4 is covered by a dome 32.

The hearing instrumental body 6 has a first end 20 that is located in the opposite end to the dome 32. The connection member 8 changes stiffness dependent on the external force (traction or compression) applied to the hearing aid device 2 in the axial direction 16.

When the hearing aid device 2 is inserted in the ear canal of the hearing aid user an external force is applied in the axial direction 16 at the end 20 of the hearing instrument due to the insertion. Applying an external force to the hearing aid device 2 in the axial direction 16 changes the configuration of the connection member 8 (by compressing the connection member 8), which increases the stiffness of the connection member 8.

The applied force causes compression of the flexible soft elements 26 arranged between the stiff elements 28. This configuration is shown in FIG. 3 *c*).

Due to the large stiffness, the stiff and rigid elements 28 do basically not change form when an external force is applied to the hearing aid device 2 during insertion of the hearing aid device into the ear canal.

When the hearing aid device 2 has been inserted into the ear canal no further external forces will be applied. Accordingly, the compressed soft elements 26 will expand and gradually regain their original thickness as shown in FIG. 3 *b*).

The connection member 8 comprises a compression structure 36 comprising a plurality of flexible elements 26 and a plurality of stiffer elements 28, wherein the flexible elements 26 and the stiffer elements 28 are arranged side by side, i.e. adjacent to each other or alternately in succession.

The connection member 8 is connected to the hearing instrumental body 6 by means of one of the flexible elements 26, however the connection member 8 may alternatively be connected to the hearing instrumental body 6 by means of one of the stiff elements 28.

The connection member 8 is connected to the receiver 4 by means of one of the stiff elements 28, but may also be connected to the receiver 4 by means of one of the soft elements 26. The soft elements 26 are made of flexible soft material, which has the ability to go from a compressed form to an expanded form and vice versa dependent on the external force applied. If no external force is applied to the soft elements 26, the elements 26 will have their original expanded shape (resting length), however if an external force is applied to the soft elements 26, they will be compressed. When the external force is no longer applied, the elements 26 will gradually expand and regain their original form (resting length).

The stiff elements 28 are made of a material, which is significantly stiffer that the soft elements 26. The material of the stiff elements 28 will be compressed to a much smaller extent than the soft elements 26 when the same external force is applied to the hearing aid device 2. The external force will be applied either by a finger or by an insertion tool, when the hearing aid device 2 is inserted into the ear canal.

FIG. 3 *b*) schematically illustrates the connection member 8 in an uncompressed form in which no or only a minor external force is applied to the connection member 8.

FIG. 3 *c*) schematically illustrates the connection member 8 in a compressed form, in which an external force is applied to the connection member 8.

Figure 4:
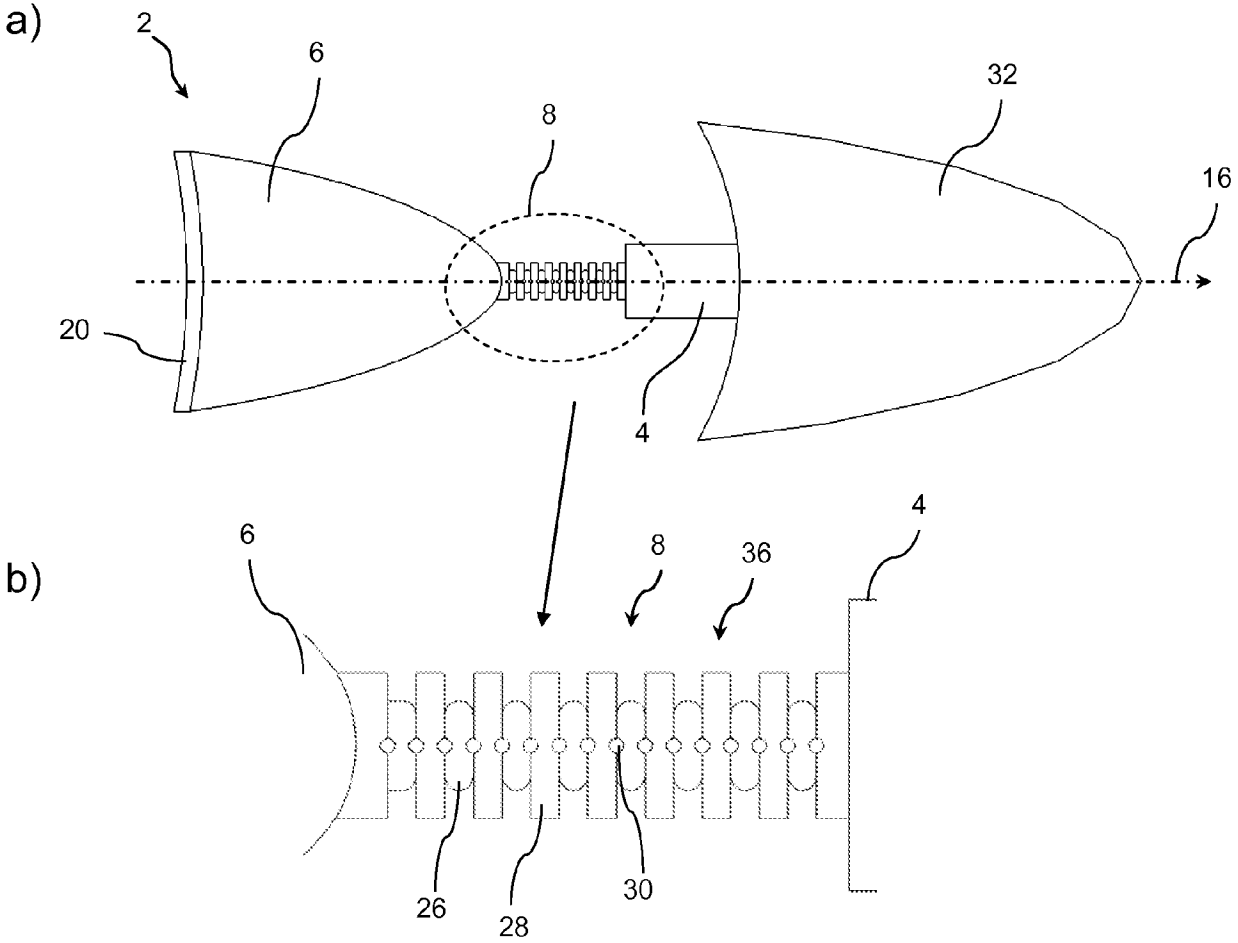
FIG. 4 shows a schematically view of a hearing aid device according to an embodiment of the disclosure, wherein the connection member is a compression structure with ball joints.

FIG. 4 *a*) schematically illustrates a view of a hearing aid device 2 according to an embodiment of the disclosure. The hearing aid device 2 has a hearing instrumental body 6, which is connected to a receiver 4 by a connection member 8. FIG. 4 *b*) illustrates a schematic view of the connection member 8 from the hearing aid device 2 (shown in FIG. 4 *a*).

A dome 32 is attached to the receiver 4. The hearing aid device 2 corresponds to the one shown in FIG. 3, however the connection member is slightly different.

The connection member 8 comprises a plurality of stiff elements 28 and soft elements 26 interconnected by ball bearings 30. The ball bearings 30 increase the flexibility of the connection member 8, because the ball bearings 30 make it possible for the connection member 8 to bend and hereby displacing the receiver 4 and/or the instrument body 6 so that they no longer are perfectly aligned along the longitudinal axis extending in the axial direction 16 (indicated in FIG. 4 *a*). This higher degree of flexibility makes the hearing aid device 2 more comfortable to wear for the hearing aid user.

When applying an external force (e.g. during insertion of the hearing aid device 2 into the ear canal) at the end of the hearing instrument body 20 and in the axial direction 16, the external force causes compression of the soft element 26, which reduces the distance between the stiffer elements 28.

When the hearing aid device 2 has been inserted into the ear canal no further external forces is required. When no external force is applied to the hearing aid device 2, the compressed soft element 26 will expand and regain their original length. When an external force is applied and the connection member 8 is compressed the ball bearings 30 ability to are rotate is significantly restricted. Accordingly, the connection member 8 will remain relatively rigid. However, when no external force is applied to the hearing aid device 2, the compressed soft elements 26 will expand and regain their resting lengths and the connection member 8 will regain its ability to bend along an axis in the axial direction 16.

Figure 5:
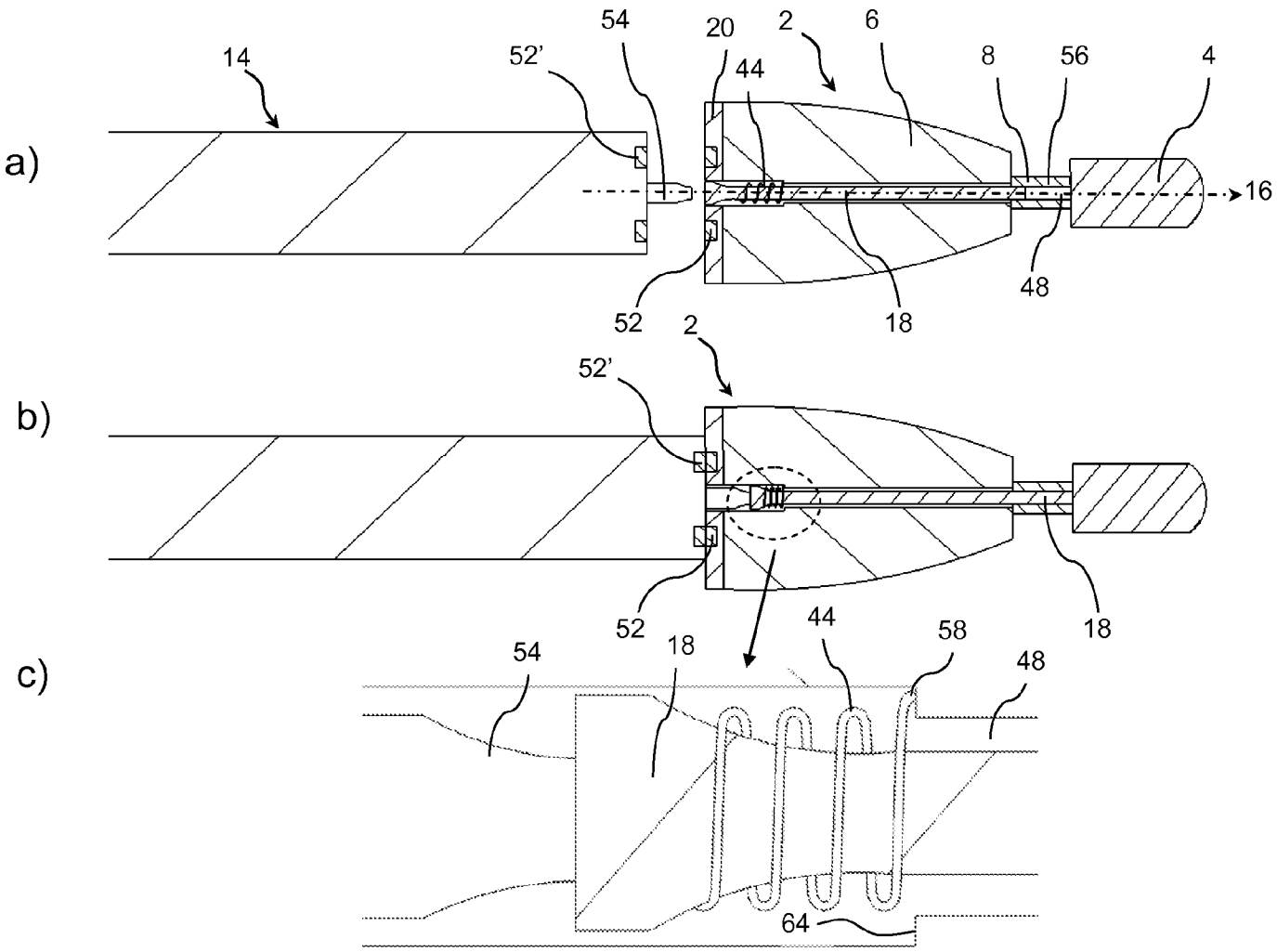
FIG. 5 shows cross-sectional views of a hearing aid device according to an embodiment of the disclosure, wherein the flexibility of the connection member is regulated by an insertion tool.

FIG. 5 *a*), FIG. 5 *b*) and FIG. 5 *c*) illustrate three cross-sectional views of a hearing aid device 2 according to an embodiment of the disclosure. The hearing aid device 2 comprises a hearing instrumental body 6, which is connected to the receiver 4 by a connection member 8. The hearing instrumental body 6 may comprise a number of elements such as a battery, a microphone and an audio signal processing electronics including an amplifier. The receiver 4 comprises a housing, which comprises the hearing aid loudspeaker (not indicated in FIG. 5). The receiver 4 is configured to receive a dome (not shown) making the hearing aid device 2 comfortable to wear for the hearing aid user. Two magnets 52 are arranged in the end of the hearing instrumental body 20. A displacement member canal 48 extends centrally through the hearing instrumental body 6 and further through a canal in the connection member 8.

A displacement member 18 is slidably arranged within a displacement member canal 48 of the hearing instrumental body. A spring 44 is twisted around a distal portion of the displacement member 18. The spring 44 bears against a radially extending flange 64 provided in the displacement member canal 48.

FIG. 5 *a*) illustrates a cross-sectional view of a hearing aid device 2 configured to engage with an insertion tool 14. The insertion tool 14 is used to insert the hearing aid device 2 into the ear canal of the hearing aid user. The insertion tool 14 is rod-shaped. At the distal end of the insertion tool 14 two magnets 52' and an activation member 54 are provided.

When the insertion tool 14 is not inserted into the end of the hearing instrumental body 20 the connection member 8 is capable of bending. The displacement member canal 48 extends through the connection member 8 that comprises a cylindrical member 56 made in a protection material.

The protection material 56 may have a stiffness that is temperature dependent. It may be an advantage that the material is relatively stiff at temperatures about 20° C. and significantly less stiff at temperatures about 30° C. The protection material 56 may, however, be any suitable material that is flexible at temperatures in the range of 37° C.

The connection member 8 is connected to the receiver 4. The receiver 4 is configured to receive and maintain a dome (not shown).

FIG. 5 *b*) illustrates a cross-sectional view of a hearing aid device 2 in which the insertion tool 14 has been inserted into the ear canal 10 of the hearing aid user. Accordingly, the hearing instrumental body 6 and the insertion tool 14 are connected and the magnets 52 and 52' are pairwise attached to each other (such that a south pole is connected to a north pole or vice versa).

When the insertion tool 14 engages the hearing instrumental body 6, the displacement member 18 is displaced into the displacement member canal 48 of the connection member 8. Accordingly, the stiffness of the connection member 8 is increased significantly.

Consequently, the spring 44 arranged around the displacement member is compressed.

When the insertion tool 14 is removed from the hearing aid device 2 the spring canal 44 will push the displacement member 18 back to the position illustrated in FIG. 5 *a*).

Figure 6:
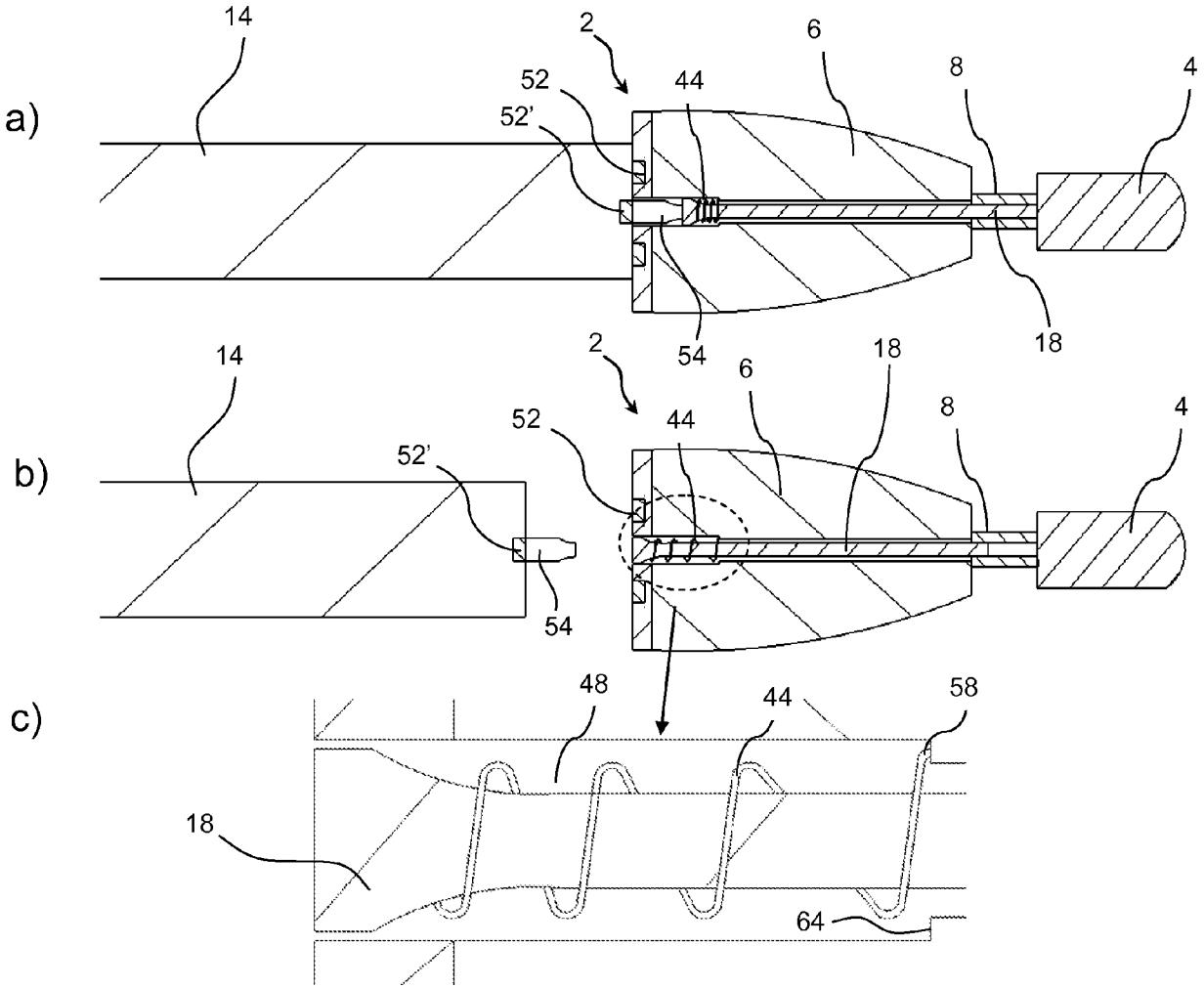
FIG. 6 shows cross-sectional views of a hearing aid device according to an embodiment of the disclosure, wherein the flexibility of the connection member is regulated by an insertion tool.

FIG. 6 *a*) illustrates a cross-sectional view of a hearing aid device 2 according to an embodiment of the disclosure. An insertion tool 14 has been inserted into the hearing device 2 e.g. during insertion of the hearing aid device. The activation member 54 of the insertion tool 14 bears against the distal end of the displacement member 18 and thus the displacement member 18 is completely received by the connection member. Accordingly, the stiffness of the connection member 8 is increased sufficiently to insert the hearing aid device 2 into the ear canal of the hearing aid user.

When the hearing aid device 2 has been inserted into the ear canal, the insertion tool 14 needs to be removed from the hearing instrumental body 6 (otherwise the insertion tool 14 would make it uncomfortable for the user to wear the hearing aid device 2). The insertion tool 14 is removed from the hearing instrumental body 6 by rotating the insertion tool 14 clockwise or counter-clockwise e.g. 90°. Hereby, the magnets 52' on the insertion tool 14 will no longer engage with the magnets 52 on the hearing instrumental body 6. Accordingly, the insertion tool 14 can be removed from the hearing instrumental body 6 and the ear.

FIG. 6 *b*) illustrates a cross-sectional view of the hearing aid device 2, shown in FIG. 6 *a*). The insertion tool 14 has, however, been removed from the hearing aid device 2 and the activation member 54 no longer bears against the distal end of the displacement member 18. The spring 44 has regained its resting length and thus the spring 44 has axially displaced the displacement member 18 towards the insertion tool 14.

Since the displacement member 18 is removed from the connection member 8, the stiffness of the connection member 8 is reduced making it more comfortable for the user of the hearing aid device 2 wear the hearing aid device.

FIG. 6 *c*) illustrates a close-up view of the distal and central portion of the hearing aid device illustrated in FIG. 6 *b*). It can be seen that the end 58 of the spring 44 bears against a flange 64 provided in the displacement member canal 48.

Figure 7:
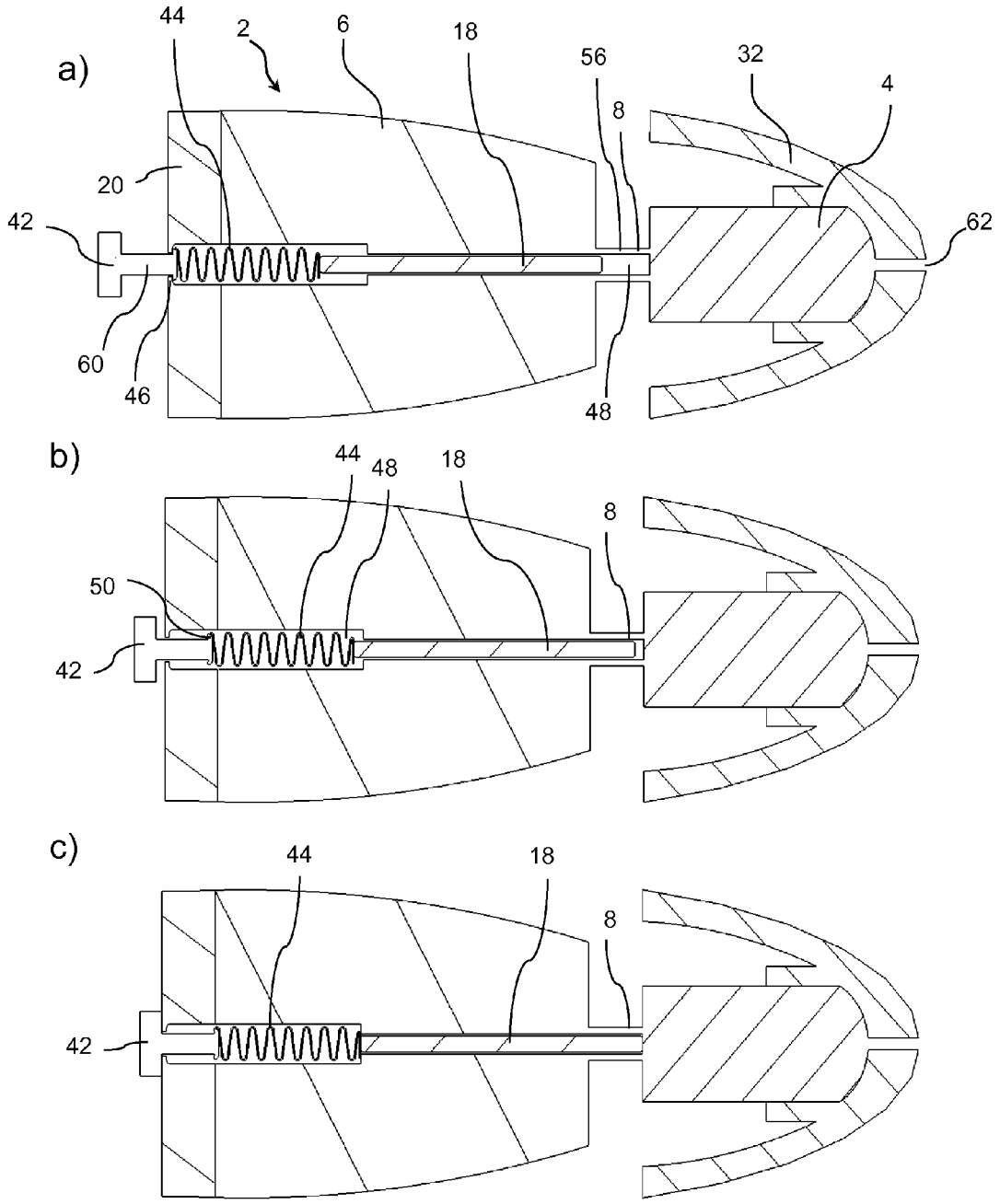
FIG. 7 shows cross-sectional views of a hearing aid device according to an embodiment of the disclosure, wherein the flexibility of the connection member is configured to be regulated by a press button.

FIG. 7 illustrates cross-sectional views of a hearing aid device 2 according to an embodiment of the disclosure. The hearing aid device 2 comprises a hearing instrumental body 6, which is connected to a receiver 4 by a connection member 8. A dome 32 is attached to the receiver 4. A displacement member canal 48 extends typically through the central portion of the hearing instrumental body 6.

In FIG. 7 *a*) a portion of the displacement member 18 is received by the displacement member canal 48, whereas the connection member 8 has not received the displacement member. Accordingly, the connection member 8 is relative flexible. The connection member 8 comprises a cylindrical member comprising a protection material. It may be an advantage that the protection material 56 is temperature dependent and relative flexible at temperatures about 30-37° C.

The hearing aid device 2 comprises a button 42 slidably arranged within the end of the hearing instrumental body 20. The button 42 comprises a rod-shaped shaft 60 and is configured to control the movements of the displacement member 18 and thereby the flexibility of the connection member 8. A flange 50 provided at the distal end of the shaft prevents the button 42 from falling out of the hearing instrumental body 6.

A radially extending holding member 46 is provided at the distal end of the hearing instrumental body 20. The holding member 46 and the flange 50 prevent the button from falling out of the displacement member canal 48. A spring 44 is attached to the proximal end of the button. The other end of the spring 44 is attached to the end of the displacement member 18.

In FIG. 7 *a*) the button 42 is not pressed into the hearing instrumental body 6 and the displacement member 18 has not been inserted into the connection member 8. Accordingly, the connection member 8 is relative flexible.

FIG. 7 *b*) illustrates a cross-sectional view of the hearing aid device 2 in a state in which the button 42 has been partly pressed into the displacement member canal 48. The spring 44 has displaced the displacement member 18 almost all the way into the connection member 8. Hereby the stiffness of the connection member 8 is increased.

In FIG. 7 *c*) the button 42 is completely pressed into the hearing instrumental body 6. Thus, the spring 44 presses on the displacement member 18 and displaces the displacement member 18 into the connection member 8. Accordingly, the stiffness of the connection member 8 is increased.

When the hearing aid device 2 has been inserted in the ear canal and no force is applied to the button 42, the spring 44 will contract and hereby displace the displacement member 18 to the left and accelerate the displacement member 18. The inertia of the accelerated displacement member will cause the button 42 to move further to the left. Accordingly a configuration as illustrated in FIG. 7 *a*) will be achieved.

Figure 8:
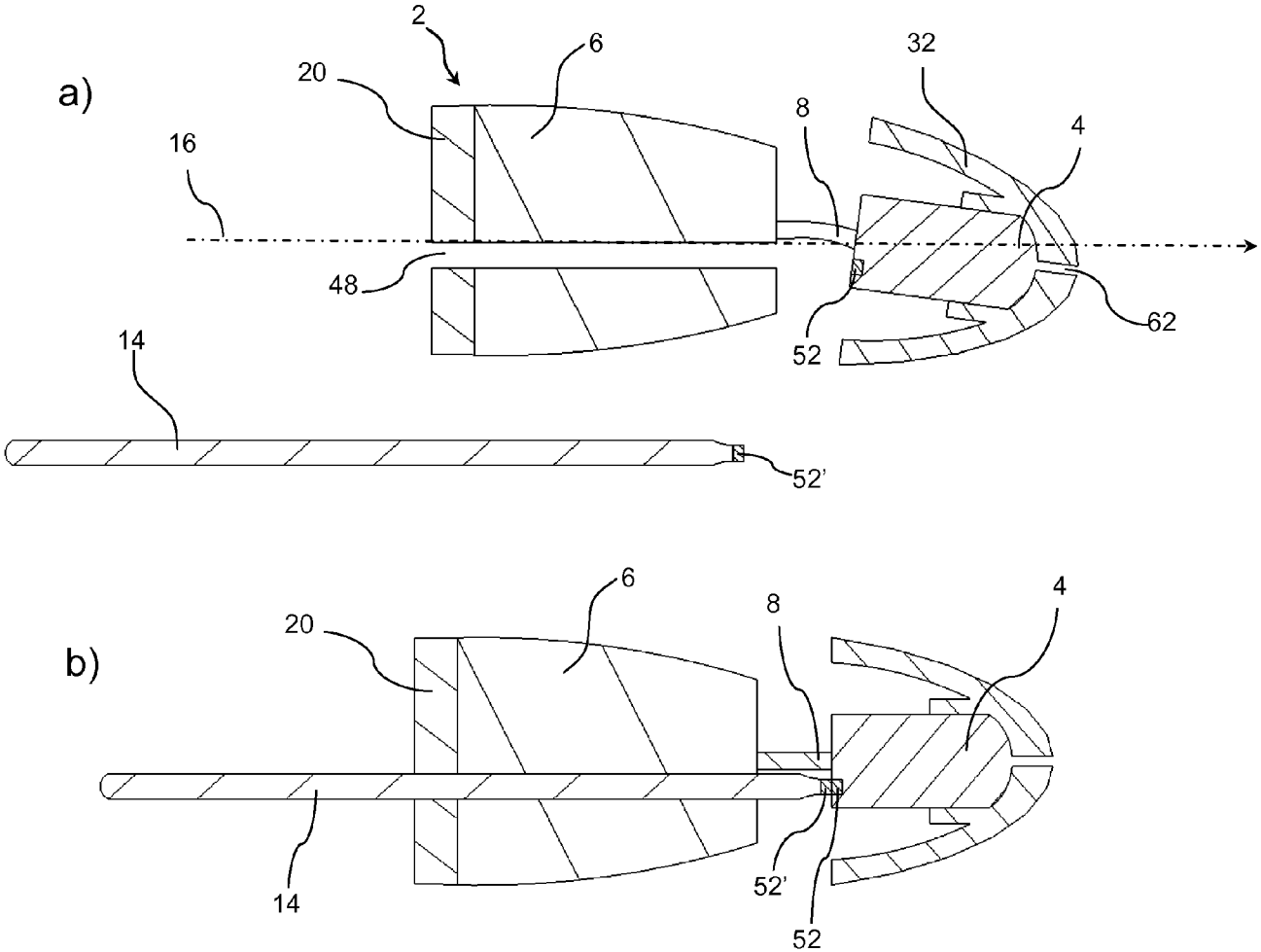
FIG. 8 shows cross-sectional views of a hearing aid device according to an embodiment of the disclosure, wherein the flexibility of the connection member is configured to be regulated by an insertion tool.

FIG. 8 illustrates a cross-sectional view of a hearing aid device 2 according to an embodiment of the disclosure. The hearing aid device 2 comprises a hearing instrumental body 6, which is connected to a receiver 4 by a connection member 8.

At the end of the receiver in the end towards the hearing instrumental body 6 a magnet 52 is attached to the receiver 4. A dome 32 is attached to the receiver 4. At the top of the dome 32 a small sound canal 62 is provided.

A through-going displacement member canal 48 extending parallel to an axis 16 is provided in the hearing instrumental body 6. The connection member 8 is placed next to the displacement member canal 48 and is shaped as a thin tube. The connection member 8 may be made in a material that is flexible and bendable at temperatures about 30-37° C. On the other hand, the stiffness of the connection member 8 may be significantly higher at lower temperatures.

The insertion tool 14 is rod-shaped and comprises a magnet 52' provided at the tip of the insertion tool 14. The magnet 52' is configured to be attached to the magnet 52 of the receiver 4.

FIG. 8 *a*) illustrates a cross-sectional view of the hearing aid device 2 in a configuration, in which the insertion tool 14 is not inserted in the hearing aid device 2.

FIG. 8 *b*) illustrates a cross-sectional view of the hearing aid device 2 in a configuration, in which the insertion tool 14 has been inserted into the hearing aid device. When inserted into the hearing aid device 2 the insertion tool 14 stabilises and assists the connections member 8. The magnet 52' on the insertion tool 14 is connected to the magnet 52 on the receiver 4.

Figure 9:
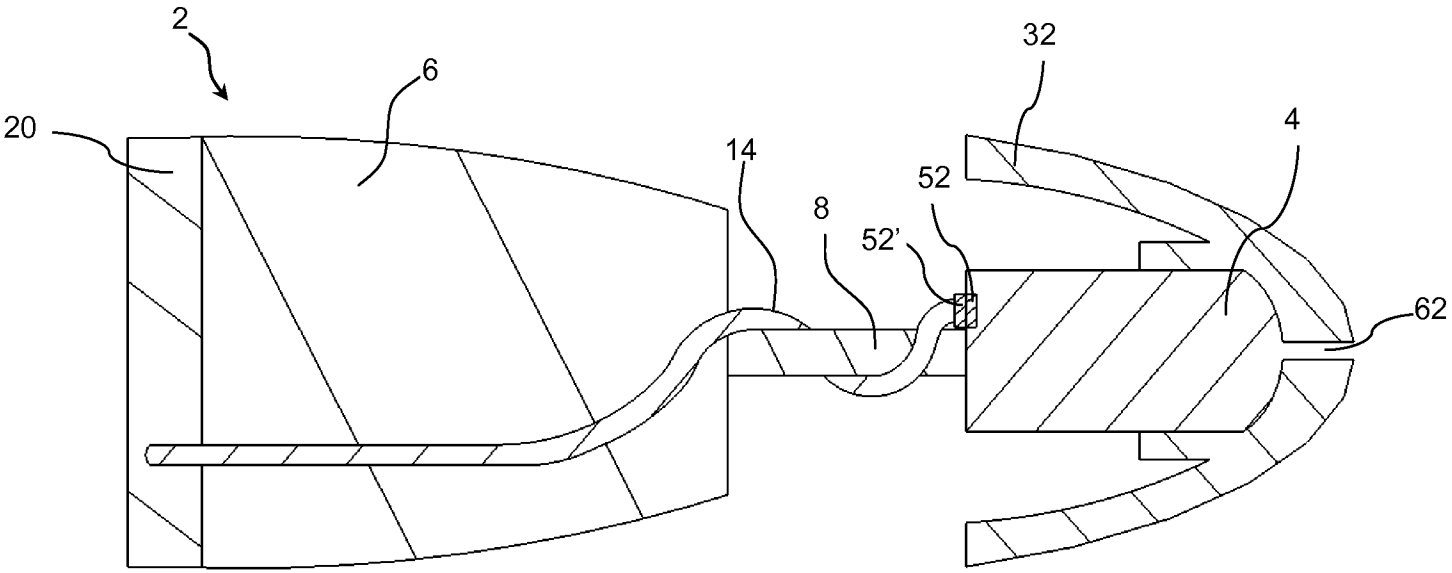
FIG. 9 shows a cross-sectional view of a hearing aid device according to an embodiment of the disclosure, wherein the flexibility of the connection member is adapted to be regulated by an insertion tool.

FIG. 9 illustrates a cross-sectional view of a hearing aid device 2 according to an embodiment of the disclosure. The hearing aid device 2 comprises a hearing instrumental body 6 interconnected to a receiver 4 by a connection member 8. A dome 32 is attached to the receiver 4. A magnet 52 is provided at the end of the receiver.

A sound canal 62 is provided in the dome 32. The connection member 8 is relative flexible making it comfortable for the user to wear the hearing aid device 2, because the connection member 8 can follow the movements of the head of the user.

To insert the hearing aid device 2 in the ear of the user the hearing aid device 2 needs to be relatively rigid. Before insertion of the hearing aid device 2, an insertion tool 14 is inserted in the hearing instrument body 6 and at the end portion 20 of the hearing instrument body 6. The insertion tool is attached to the end portion 20 and is wrapped/twisted around the connection member 8, and is finally locked by connecting the magnet 52' of the insertion tool 14 to the magnet 52 on the receiver 4.

Wrapping the insertion tool 14 around the connection member 8 makes the connection member 8 rigid due to friction between the connection member 8 and the insertion tool 14. The insertion tool 14 has the shape of a long, flexible rod.

The insertion tool 14 and the connection member 8 may be made of a material which is flexible at temperatures about 30-37° C. and that is stiffer at lover temperatures (e.g. at about 20-30° C.).

Figure 10:
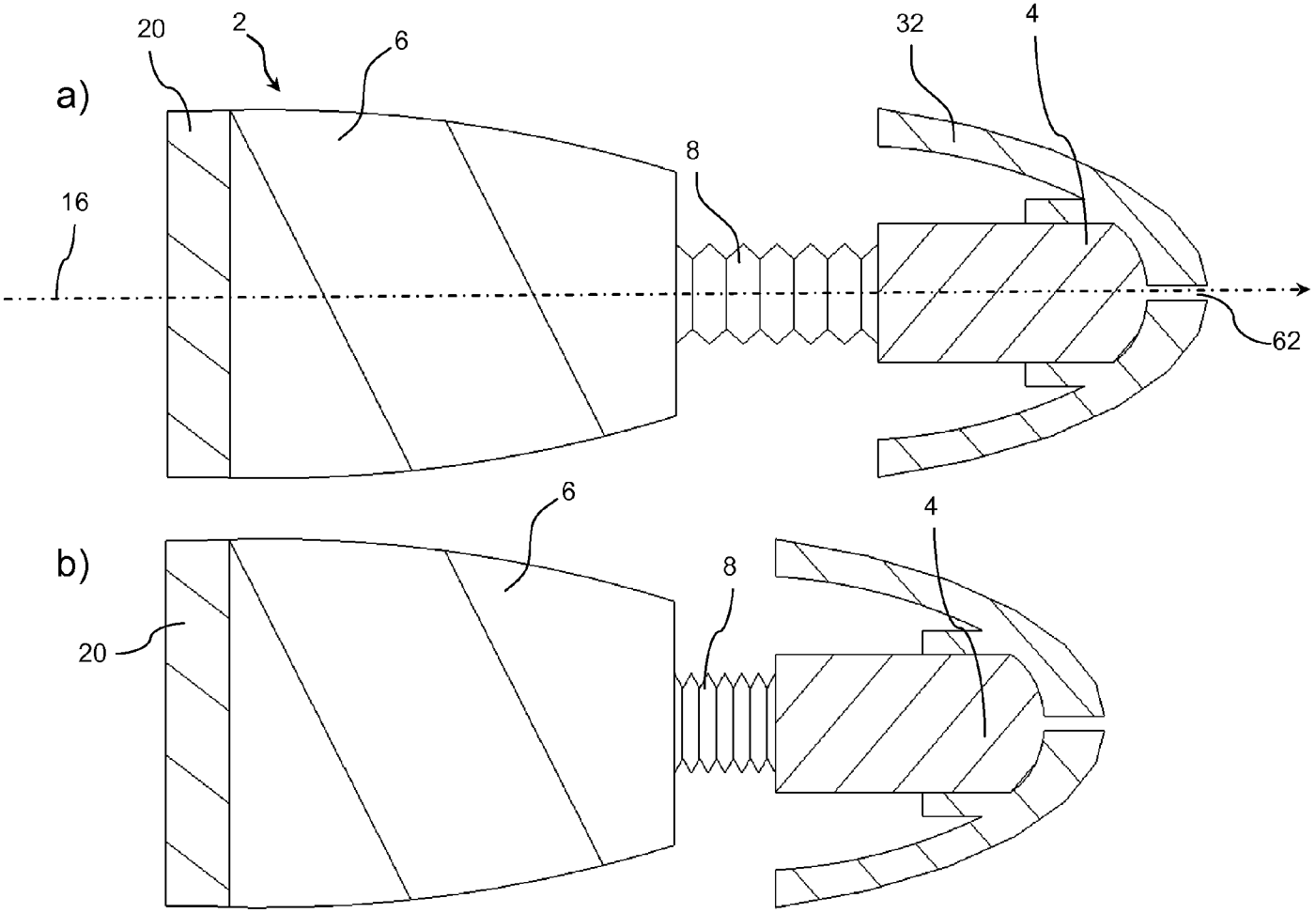
FIG. 10 shows cross-sectional views of a hearing aid device according to an embodiment of the disclosure in two different states of operation.

FIG. 10 illustrates two cross-sectional views of a hearing aid device 2 according to an embodiment of the disclosure. The hearing aid is mechanically attached to a receiver 4 by means of a connection member 8. The hearing instrumental body 6 has a distal end 20. A dome 32 provided with a sound canal 62 is attached to the receiver 4.

FIG. 10 *a*) illustrates the hearing aid device 2 in a first state, in which the connection member 8 and thus the hearing aid device 2 is relative flexible and thus comfortable to wear for the user. In order for the hearing aid device 2 to be flexible and comfortable to wear for the user, a certain flexibility of the connection member 8 is required. This means that the connection member needs to be flexible in the axial direction 16 and/or perpendicular on the axial direction 16. In FIG. 10 *a*) the connection member 8 is in a non-compressed state. The connection member is configured to be bended in such a manner that it can follow the movements of the head of the hearing aid user.

FIG. 10 *b*) illustrates a hearing aid device 2 in a state in which the connection member 8 is compressed. The connection member 8 may be compressed by applying a force in the axial direction 16 and hereby pressing the hearing instrumental body 6 and the receiver 4 together. When the connection member 8 is in the compressed state, its stiffness will increase significantly and it will be suitable for being inserted into the ear.

When the hearing aid device 2 has been inserted in the ear and no force is applied, the connection member 8 will regain its original (resting) length like illustrated in FIG. 10 *a*).

LIST OF REFERENCE NUMERALS

2—Hearing aid device
4—Receiver
6—Hearing instrument body
8—Connection member
10—Ear canal
12—Eardrum
14—Insertion tool
16—Axial direction
18—Displacement member
20—End
22—Foam member
24—Wire
26—Soft element
28—Stiff element
30—Ball bearing
32—Dome
34—Material
36—Compression structure
38, 40—End
42—Button
44—Spring
46—Holding member

48—Displacement member canal
50—Flange
52, 52'—Magnet
54—Activation member
56—Protection material
58—End
60—Shaft
62—Sound canal
64—Support surface

The invention claimed is:

1. A hearing aid device configured to be inserted into the ear canal of a hearing aid user, said hearing aid device comprising:

a receiver;

a hearing instrument body; and a connection member extending between the hearing instrument body and the receiver, wherein the connection member is a permanent part of the hearing aid device, the connection member has a stiffness that allows the receiver to be inserted into the ear canal by moving the hearing instrument body towards the hearing aid user's eardrum, the connection member comprises a mechanical support having a stiffness that is temperature dependent, such that the mechanical support has a first stiffness, at a first temperature that is less than the temperature within the ear canal, that is sufficiently large to insert the hearing aid device into the ear canal and has a second, significantly reduced stiffness, at temperatures above the first temperature, that makes the hearing aid device comfortable to wear for the user, and the connection member further comprises flexible tubing containing wires for electrically connecting the receiver and the instrument body, the flexible tubing that contains wires being embedded in the mechanical support and being configured to provide mechanical stability as a pulling force is applied to the wires during removal of the hearing aid device from the user's ear canal.

2. The hearing aid device according to claim 1, wherein the first temperature is within the range of 25-35° C.

3. The hearing aid device according to claim 2, wherein the first temperature is within the range between 27° C. and 30° C.

4. The hearing aid device according to claim 1, wherein the connection member has a conical shape.

* * * * *